US008960858B2

(12) United States Patent
Lutz

(10) Patent No.: US 8,960,858 B2
(45) Date of Patent: Feb. 24, 2015

(54) PRINT-HEAD MODULE

(75) Inventor: Patrik Lutz, Markt Erlbach (DE)

(73) Assignee: PadaLuma Ink-Jet-Solutions GmbH & Co. KG, Markt Erlbach (DE)

( * ) Notice: Subject to any disclaimer, the term of this patent is extended or adjusted under 35 U.S.C. 154(b) by 0 days.

(21) Appl. No.: 13/701,637

(22) PCT Filed: Jun. 18, 2010

(86) PCT No.: PCT/EP2010/003681
§ 371 (c)(1),
(2), (4) Date: Jan. 10, 2013

(87) PCT Pub. No.: WO2011/157281
PCT Pub. Date: Dec. 22, 2011

(65) Prior Publication Data
US 2013/0100209 A1 Apr. 25, 2013

(51) Int. Cl.

| | |
|---|---|
| ***B41J 2/015*** | (2006.01) |
| ***B41J 2/14*** | (2006.01) |
| ***B41J 2/16*** | (2006.01) |
| ***B41J 25/34*** | (2006.01) |
| ***B41J 2/515*** | (2006.01) |

(52) U.S. Cl.
CPC . *B41J 25/34* (2013.01); *B41J 2/515* (2013.01)
USPC ..... 347/49; 347/20

(58) Field of Classification Search
CPC ..... B41J 25/34; B41J 25/316; B41J 2/515
See application file for complete search history.

(56) References Cited

U.S. PATENT DOCUMENTS

| | | | | |
|---|---|---|---|---|
| 5,359,358 | A * | 10/1994 | Shimamura et al. | 347/9 |
| 7,311,378 | B2 * | 12/2007 | Fujimori et al. | 347/33 |
| 2008/0273910 | A1 | 11/2008 | Verlinden et al. | |
| 2012/0306960 | A1 * | 12/2012 | Niihara et al. | 347/20 |
| 2013/0271517 | A1 * | 10/2013 | Leoni et al. | 347/6 |

FOREIGN PATENT DOCUMENTS

| | | | |
|---|---|---|---|
| EP | 0 400 652 | A2 | 12/1990 |
| WO | W02005108094 | A1 | 11/2005 |
| WO | W02008152903 | A1 | 12/2008 |

OTHER PUBLICATIONS

English Translation of the International Search Report; Mailed Jan. 3, 2012 for corresponding PCT Application No. PCT/EP2010/003681.
International Search Report mailed Apr. 29, 2011 for corresponding PCT Application No. PCT/EP2010/003681.

* cited by examiner

*Primary Examiner* — Stephen Meier
*Assistant Examiner* — Renee I Wilson
(74) *Attorney, Agent, or Firm* — Mendelsohn, Drucker & Dunleavy, P.C.; Steve Mendelsohn

(57) ABSTRACT

A print-head module for a single-pass inkjet printer is specified, which print-head module includes a housing, a hangar part which is fastened to the housing for hanging in a manner which is oriented in the direction of gravity, and a number of print heads which are arranged on the housing along a transverse direction which is perpendicular with respect to a running direction, wherein the print heads are positionally adjusted at least at one reference position. The print-head module can be exchanged simply and rapidly. Complicated re-adjustment on the single-pass inkjet printer can be dispensed with.

20 Claims, 1 Drawing Sheet

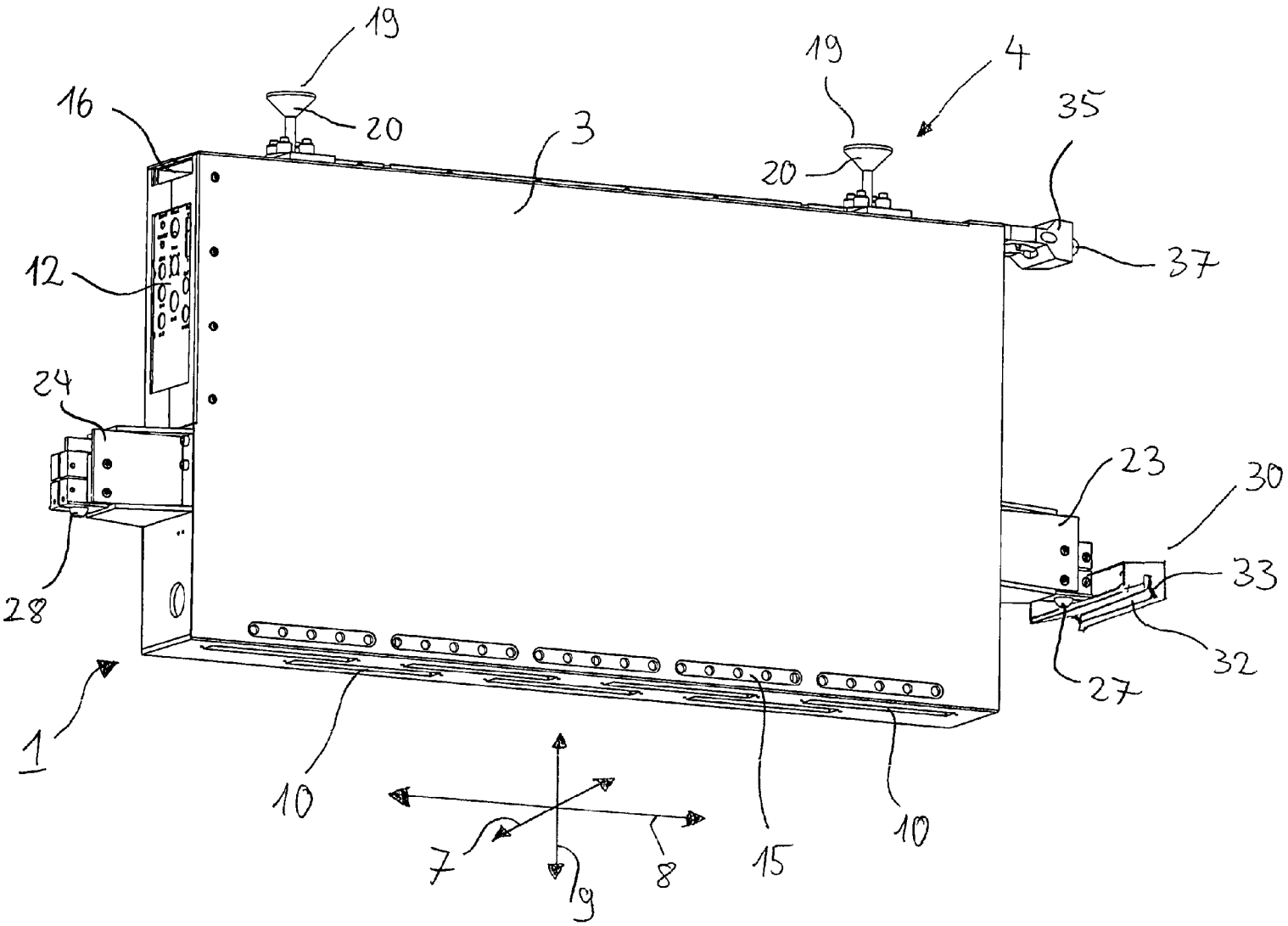
4
19
20
19
20
3
16
12
24
28
1
35
37
23
30
33
32
27
10
15
10
8
9
7

PRINT-HEAD MODULE

FIELD

The invention relates to a print-head module for a single-pass inkjet printer, which print-head module comprises a housing and a number of print heads which are arranged on the housing along a transverse direction which is perpendicular with respect to a running direction.

BACKGROUND

Whereas, in a conventional inkjet printer, the print heads which are mounted on a carriage spray ink droplets line by line in the transverse direction onto the medium which is transported discontinuously in the running direction, in a single-pass inkjet printer the print heads are mounted in print head modules of the type mentioned in the introduction over the entire width of the medium in the transverse direction. The printing medium can be moved continuously in the running direction. Whereas printing speeds of up to 2 m per minute are reached in a conventional inkjet printer, printing speeds of up to over 50 m per minute are achieved by way of a single-pass inkjet printer. For color printing, a plurality of print-head modules are mounted behind one another in the running direction in a single-pass inkjet printer. Here, the print-head modules are assigned in each case one primary color, in particular cyan, magenta and yellow and possibly black. For special printing uses, print-head modules having a special color can be added.

A single-pass inkjet printer is suitable, in particular, for industrial use, in which high-quantity goods have to be printed and a high throughput is therefore important. On account of the high printing speeds, a single-pass inkjet printer is likewise suitable for printing objects with a large surface area. A single-pass inkjet printer is therefore suitable, in particular, for industrial applications of the furniture or ceramic industry, where floor coverings, such as laminates or ceramic tiles, counter tops, profiled strips or the like are to be provided with a decorative pattern. Here, a very wide variety of inks are used which are, for example, resistant with respect to a subsequent protective coating, etc.

In comparison with conventional printing processes, such as gravure printing or the like, the single-pass inkjet printer is also used precisely in the case of small production batches, where the production of an impression roll is not worthwhile. In contrast, a single-pass inkjet printer also makes individualization of the decorative patterns possible, and also impossible decorative patterns which cannot be achieved by way of rolls. The single-pass inkjet printer is not restricted to a constant repetition of a printing pattern or repeating pattern, as is the case in rotary printing.

A print-head module for a single-pass inkjet printer can certainly reach dimensions of more than half a meter up to over a meter in the transverse direction and vertically. The individual print heads which are combined in the print bar of a print-head module can have widths of up to several tens of cm. Here, resolutions of up to 600×600 dpi (dots per inch) are possible. Here, several thousand nozzles are contained per print head. Printing widths of up to several meters can be achieved by way of large print-head modules or by way of the arrangement of a plurality of print-head modules next to one another.

Positional deviations of a few micrometers are visible to the human eye in a printed image. In the case of the above-mentioned resolutions, the individual nozzles of a print head lie only several tens of μm apart from one another. The size of an image point is itself in the region of 10 μm. In a single-pass inkjet printer having a plurality of print-head modules which are arranged behind one another in the running direction, it can be seen that an adjustment of the print heads in the micrometer range becomes necessary, in order to produce a high-quality printed image. The adjustment of a print-head module in a single-pass inkjet printer is therefore complicated. The position of the print heads has to be detected, for example, by optical microscope and has to be set manually in a complicated way. The setting up of a single-pass inkjet printer is thus comparatively protracted. An adjustment also has to be carried out for each replacement of a print-head module. This leads to an unnecessary extension of the down times.

SUMMARY

It is an object of at least one embodiment of the invention to specify a print-head module for a single-pass inkjet printer, which print-head module can be exchanged as rapidly and simply as possible. The setting up of a single-pass inkjet printer having a print-head module of this type is also to be capable of being performed as rapidly as possible.

According to the embodiment, the stated object is achieved by a print-head module of the type which is stated at the outset, a connection part which is fastened to the housing being provided for gravity-oriented connection, and the individual print heads which are arranged on the housing being adjusted positionally with respect to at least one reference position.

Here, the embodiment proceeds from the consideration that hanging fastening of the print-head modules in principle makes facilitated installation and dismantling in the vertical position possible. A hanging print-head module can be readily removed from, in particular raised out of, a printing position which is fixed to the unit, for example, and can be moved into an accessible cleaning or removal position above or below the printing position. At the same time, a hanging arrangement of the print-head module permits automatic orientation on account of gravity which acts at the centroid. As a result, during the insertion of the hanging print-head module, there is already rough positioning with respect to the subsequent printing position which is fixed to the unit. As a result, the hanging fastening makes self-adjustment of the print-head module into the printing position which is fixed to the unit possible, in particular without complicated mechanical auxiliary constructions, without manual subsequent adjustment becoming necessary. The setting up of any mechanical guide elements is simplified by the automatic positioning of the hanging print-head module as a result of gravity, in comparison with complicated positive guides.

In addition to a connection means for the print-head module, for example, bearings or guide elements which, during the introduction in a vertical direction, move the print-head module into the fixed, final printing position can be provided on the single-pass inkjet printer. In particular, the mechanical elements which are provided for this purpose are configured in such a way that merely lowering or raising the print-head module leads to the fixed printing position being reached. By lowering or raising the print-head module, the latter leaves the printing position and can be returned reversibly into said printing position again in a simple way.

In addition to the print heads, the print-head module can at the same time contain, in particular, control electronics and optionally an ink tank. However, the invention is not restricted in any way to comparatively large designs of this type.

The connection part is preferably configured in such a way that it is used, in interaction with the single-pass inkjet printer, as a locating or floating bearing for fixing the end position. The connection part can also be configured, in particular, in such a way that it can be raised out of the connection means in the vertical direction. In the final printing position, this then permits upright fastening of the print-head module. Accordingly, during the hanging insertion, the centroid of the print-head module is situated below the bearing point of the connection or connection part. In the achieved printing position which is fixed to the unit, in the case of upright fastening, in contrast, the centroid of the print-head module is arranged above a lower bearing point which then results.

The connection part is preferably configured as a connection piece which can be hooked into a connection means in a swinging manner. For example via a printer-side raising/lowering device, swinging fastening of the print-head module permits the necessary degrees of freedom which are necessary for the orientation of the print-head module between its free hanging position and the printing position which is fixed to the unit. The swinging arrangement can be provided in principle by a suitable mechanical connection means. Here, knife-edge or ball socket bearings are likewise conceivable, such as a hanging attachment via a flexible connecting part, such as a cable element or the like. In the latter case, the cable element itself represents the connection piece. Otherwise, the connection part is configured to be, for example, spherical, conical or in the manner of a nipple.

The connection of the print-head module is preferably used as a bearing for fixing the printing position. Here, in one advantageous design variant, the connection parts are configured in such a way that the connected print-head module can be connected parallel to the transverse direction and is arranged so as to swing about a polar angle. Important prepositioning is achieved by way of the orientation of the print-head module parallel to the transverse direction. The perpendicular orientation of a print-head module, which extends in the transverse direction, with respect to the running direction of the printing medium is essential for the printing quality which can be achieved. If there is a deviation from the perpendicular angle with respect to the running direction, this leads to an offset of the individual printer dots with respect to the desired position of the image point in the transverse direction. To this end, the connection means for the print-head module is configured, for example, as a floating bearing which permits a displacement in the transverse direction, but does not permit any degree of freedom in the running direction. A bearing of this type with the connection part which is suitable for this purpose can be configured, in particular, as a slide guide in the transverse direction.

To this end, the connection piece is preferably configured as a conical piece which can be connected into a prism depression or wedge depression or the like which runs in the transverse direction. In order to make the swinging movement possible, the opening angle of the cone is, in particular, smaller than that of the prism depression or wedge depression. If, in particular, the socket is open on one side in the transverse direction, the print-head module can be connected and removed in a simple way.

At least two connection parts which are offset in the transverse direction are advantageously provided. In this way, the desired parallel orientation of the print-head module with respect to the transverse direction is achieved necessarily upon connection.

In a further preferred refinement, catch means are arranged on the housing for rough positioning in relation to a provided printing position. In interaction with the single-pass inkjet printer, said catch means serve for rough positioning of the entering, in particular lowering print-head module. During insertion, a print-head module which is connected, in particular, in a swinging manner will orient its centroid as a result of gravity. The catch means are then configured in such a way that they are capable, upon movement of the print-head module, in particular upon lowering, of gripping any positioning elements which are fixed to the unit and of prepositioning said print-head module with respect to the final printing position.

In one advantageous refinement, the catch means are formed by a catch wedge or by a wedge shaft. If, for example, a wedge shaft is provided which is mounted on the housing of the print-head module, said wedge shaft can interact with a catch wedge which is fixed to the unit. During gradual movement, in particular lowering of the print-head module into the printing position, the wedge shaft first of all receives the wedge tip which is fixed to the unit and subsequently the entire wedge, as a result of which the print-head module is restricted further in its degrees of freedom which are still possible, for example an offset in the transverse direction or a swinging movement about the polar angle. Accordingly, the print-head module is guided positively by way of the catch means to the later fixed printing position in a targeted manner. Conversely, a catch wedge which is mounted on the housing of the print-head module can interact in the same way with a wedge shaft which is mounted in a fixed manner on the unit.

In one particularly preferred refinement, the catch wedge or the wedge shaft are configured to form a substantially vertical slide guide with a corresponding mating piece. A further movement of the print-head module in the vertical direction with simultaneous prepositioning in the transverse direction is possible by way of a slide guide of this type. Here, a catch elbow which is oriented parallel to the running direction or a groove depression which is oriented parallel to the running direction is preferably provided as catch means. Via the catch wedge which is oriented in the running direction, the polar angle is fixed increasingly during the movement of the print-head module into the printing position. The print-head module is fixed in the transverse direction via the groove depression which is oriented in the running direction.

At least two bearing pieces which are offset in the transverse direction and are configured in each case for self-adjusting positioning in an open bearing are advantageously arranged on the housing. In particular, if catch means are provided, the bearings which are self-adjusting in the vertical direction do not need to be of complicated construction. It is merely necessary that the two bearing elements which realize the bearing come together automatically during the gradual introduction of the print-head module, as a result of which ultimately the final position is fixed. Suitable bearing pieces are configured for interaction with, for example, a ball socket bearing, knife-edge bearing or a conical bearing. To this extent, the bearing pieces can be, in particular, of conical, tapered, angular, pointed or spherical configuration.

In a further preferred refinement, the bearing pieces are mounted on the housing in a height-adjustable manner. In this way, production-induced dimensional tolerances can be compensated for or the print heads can have their heights adjusted with respect to the printing position.

In one preferred refinement, one of the bearing pieces is configured for positioning in a locating bearing and the other of the bearing pieces is configured for positioning in a floating bearing in the transverse direction. Via the floating bearing, for example, an expansion of the print-head module in the transverse direction can be absorbed. In one expedient refinement, in each case the locating bearing is configured as a ball pivot bearing and the floating bearing is provided by a prism slide guide in the transverse direction. To this end, the bearing pieces are preferably configured in each case as ball pivots. The locating bearing is then advantageously equipped with a ball socket for punctiform rotary mounting, into which ball socket the spherical end of the pivot is received and positioned during the vertical introduction of the print-head module. The prism slide guide is, in particular, likewise configured as a ball pivot bearing, the socket being configured, however, with a prism-shaped cross section along the transverse direction. The prism slide guide then fixes the parallel position of the print-head module with respect to the transverse direction. A linear offset is still possible as a degree of freedom in the transverse direction itself.

It is further preferred that a stop piece is arranged on the print-head module for bearing against a stop face. A stop piece of this type orients, in particular, the inclination of the print-head module by the polar angle, as long as the connection means does not entirely restrict a degree of freedom in the running direction. This is the case, in particular, when the print-head module is configured for upright fastening in the final printing position, the connection pieces being raised out of the connection means.

The stop piece particularly advantageously comprises a ball pivot which extends in the transverse direction. During a movement of the hanging print-head module into the printing position, the ball pivot comes into contact gradually with a stop face which is fixed to the unit and finally positions the ball pivot in the running direction. Together with a, for example, spherical stop face, a ball pivot permits a defined stop independently of the vertical height. In the final printing position, the respective print-head module is then fixed exactly, for example, by the two open bearings, namely a ball pivot bearing as locating bearing and a prism slide guide as floating bearing, and by the stop piece which abuts the stop face. Here, in particular, the inclination or polar angle is fixed by the abutting stop piece. The stop piece assumes the corresponding guidance in interaction with the vertical stop face which is fixed to the unit.

A further essential aspect of at least one embodiment of the invention is the positional adjustment of the print heads with respect to at least one reference position. As a result of the fixing of the position of the print heads with respect to at least one reference position, said print heads are always oriented identically apart from unavoidable dimensional tolerances when the final printing position of the print-head module is reached. In other words, each print-head module always has the same positional orientation of its respective print heads with regard to at least one reference position. This achieves a simple exchange of the print-head modules. The positions of the print heads of the exchanged and of the newly inserted print-head modules are identical with regard to the unit side.

As a result of this measure, complicated readjustment of an inserted print-head module is dispensed with. The print heads are already adjusted apart from dimensional tolerances after the simple insertion of the print-head module. Merely during new setting up of the single-pass inkjet printer, first of all the print-head modules have to be oriented on the unit side in the respective bearing points on account of manufacturing tolerances or the like. As a result of the identical prepositioning of the print heads of all print-head modules, however, this is also simple in comparison with the previous complicated orientation on site.

For the purpose of the positional adjustment of the print heads, the latter are mounted in the print-head module such that they can be displaced, for example, in the transverse direction and in the running direction. In a suitable tool, for positional adjustment, the print-head module is moved, before being delivered, into a mounting position which is comparable with the later printing position. Subsequently, the individual print heads are adjusted, for example, by optical microscope in the micrometer range with respect to a reference position.

The print heads are preferably adjusted positionally in each case with respect to the bearing pieces, for example the ball pivots. To this end, before delivery, the print-head modules are inserted into the corresponding workpiece in accordance with the later printing position. Said tool has the identical bearings as the later single-pass inkjet printer. Since the print-head module is also positioned exactly in the tool via the two bearing pieces which are offset in the transverse direction and by way of the connection means, the print heads can be oriented, in particular, in parallel and in the transverse and running directions. The height of the print heads can then be performed, for example, via the height-adjustable bearing pieces.

In order to keep the print-head module, in particular any enclosed control electronics and the print heads per se free of dust, it is further preferred that the housing comprises a number of air slots, an air feed into the housing interior being provided. In this way, a positive pressure can be generated in the interior of the print-head module, excess air exiting to the outside again via the air slots. Dust and contaminants are kept away from the print-head module in this way.

BRIEF DESCRIPTION OF THE DRAWINGS

Exemplary embodiments of the invention will be explained in greater detail using a drawing, in which:

FIG. 1 shows a print-head module having a connection means for vertical sliding introduction.

DETAILED DESCRIPTION

FIG. 1 shows a print-head module 1 having a housing 3, on the upper side of which two connection parts 4 are arranged. The connection parts 4 make hanging introduction of the print-head module 1 on the single-pass inkjet printer possible in order to achieve a later printing position which is fixed to the unit.

For the sake of orientation, the running direction 7 of a corresponding printing medium, the transverse direction 8 which is perpendicular with respect thereto, and the vertical direction 9 are shown in FIG. 1. In the printing position which is fixed to the unit, the printing medium moves below the print-head module 1 in the running direction 7.

A number of print heads 10 are mounted in the transverse direction 8 on the underside of the print-head module 1. Here, the print heads 10 are mounted in such a way that the result is a single, contiguous printing region over the width. To this end, the print heads 10 are arranged so as to be offset with respect to one another in the running direction and so as to overlap in the transverse direction. Here, reference is made to the fact that each print head 10 comprises a number of nozzles which are held in a respective frame.

Furthermore, the print-head module 1 comprises a number of connections 12 which serve to feed in electricity, control signals and ink. The control electronics for actuating the print heads 10 and an ink tank are accommodated in the interior of the housing 3.

Furthermore, the housing 3 comprises a number of air slots 15 and an air inlet 16. Compressed air is introduced from outside via the air inlet 16, which compressed air exits to the outside again, in particular, via the air slots 15. In this way, dust or any other contaminant is kept away from the print-head module 1.

Two connection parts 4 which are offset in the transverse direction 8 are provided to form a vertical connection means of the print-head module 1. Here, the connection parts 4 are configured in each case as connection pieces 19 which make a swinging connection possible in a corresponding ball socket bearing. Here, the connection pieces 19 are shaped in each case as conical pieces 20. The conical pieces 20 have a smaller inclination angle than the socket of the corresponding bearing. When the print-head module 1 is connected, the latter is already oriented parallel to the transverse direction 8 as a result of the offset arrangement in the transverse direction of the two conical pieces 20.

The two conical pieces 20 then permit swinging of the print-head module 1 about a polar angle in the corresponding ball socket bearing. In other words, after connection, the print-head module 1 will orient itself substantially in the vertical direction as a result of gravity.

Secondly, the provided connection parts 4 also permit the setting of an inclination angle or polar angle, in order to set the print bar with the print heads 10 parallel to the track of the printing medium. The track of the printing medium can be configured, for example, as a curved arc, which makes tauter guidance of the printing medium possible.

Furthermore, bearing pieces 23, 24 which are arranged on both sides and therefore offset in the transverse direction 8 are mounted on the housing 3. In each case one height-adjustable ball pivot 27, 28 is fastened to the bearing pieces 23, 24. In addition, in each case catch means 30 are mounted on the two bearing pieces 23, 24, merely the right-hand (in FIG. 1) catch means 30 being shown. The catch means 30 comprises a wedge shaft 32 which is open in the vertical direction 9 and, on its underside, has a groove depression 33 which runs in the transverse direction 7.

During the lowering of the print-head module 1 which is connected via the connection parts 4, for example, of a raising/lowering device of a single-pass inkjet printer, the catch means 30 move gradually into position with a corresponding mating piece on the printer. Said mating piece is configured in each case as a catch wedge which is oriented in the running direction 7. Said catch wedge is first of all gripped by the groove depression 33 and slides into the vertical wedge shaft 32. The catch wedge of the single-pass inkjet printer and the wedge shaft 32 form a vertical slide guide in each case at both bearing pieces 23, 24.

During further lowering, the print-head module 1 is oriented in the polar angle and in the transverse direction, since the catch means 30 gradually slide completely onto the catch wedge which is fixed to the unit. The catch means 30 therefore bring about rough positioning of the print-head module 1 during the lowering thereof, with regard to the final printing position to be achieved.

After rough positioning, the two spherical ends of the ball pivots 27, 28 are adjusted in ball pivot bearings which are in each case open at the top. To this end, one of the ball pivot bearings comprises a socket which is fixed to the unit and has a conical depression. The other of the two bearings comprises a prism depression which runs in the transverse direction 8. The ball of the ball pivot 27 forms, with the conical depression, a three-dimensionally fixed pivot point, for example. The ball of the opposite ball pivot 28 fixes the position of the bearing piece 24 in the vertical direction 9 and in the running direction 7. A displacement is possible in the transverse direction 8 on account of the prism depression, as a result of which longitudinal extensions of the print-head module 1 are absorbed.

In the finally reached printing position, the print-head module 1 rests in the corresponding bearings of the bearing pieces 23 and 24. The two conical pieces 20 are raised out of the corresponding ball socket bearings. In this raised position, there is again a degree of freedom in the running direction 7 for the upper side of the print-head module 1. A stop piece 35 which comprises a ball pivot 37 is provided on the upper side of the housing 3 in order to fix the inclination or polar angle. During lowering of the print-head module 1, said ball pivot 37 bears laterally against a prestressed, spherical stop face of the single-pass inkjet printer. This ensures that, upon raising of the conical pieces 20, the inclination angle of the print-head module 1 is fixed exactly in the printing position which is reached.

In the printing position which is reached and is fixed to the unit, the print-head module 1 is restricted in all degrees of freedom and therefore positioned exactly by way of the three bearings which are provided.

The stop piece 35 is not necessarily required. For example, the connection means can be designed as a knife-edge bearing which exactly defines a pivot point. In particular, the connection means also does not need to be raised in the printing position.

The respective print heads 10 are adjusted positionally in the running direction 7 and in the transverse direction 8 with respect to the balls of the ball pivots 27, 28. The print heads 10 are also adjusted positionally in the vertical direction 9, with respect to a later printing position which is fixed to the unit, by height adjustment of the ball pivots 27, 28.

The positional adjustment in the transverse direction 8 and in the running direction 7 of the print heads 10 takes place by way of a longitudinally displaceable mounting in the housing 3. The positional adjustment itself is performed by optical microscope. To this end, the print-head module 1 which is shown is inserted with its bearing points into a suitable tool which forms a mounting which is identical to the later printing position.

A simple exchange of print-head modules 1 is possible as a result of the positional adjustment of the print heads 10, without complicated manual readjustment on site.

The invention is claimed is:

1. A print-head module for a single-pass inkjet printer, the print-head module comprising:

a housing, a hanger part which is fastened to the housing and which is configured for hanging the print-head module oriented in the direction of gravity, and a number of print heads which are arranged on the housing along a transverse direction which is perpendicular with respect to a running direction, which print heads are adjusted positionally with respect to at least one reference position, wherein:

the hanger part is configured as a hanger piece which is designed for hanging the print-head module in a swinging manner; and the hanger piece is configured as conical piece.

2. A print-head module for a single pass inkjet printer, the print-head module comprising:

a housing, a hanger part which is fastened to the housing and which is configured for hanging the print-head module oriented in the direction of gravity, and a number of print heads which are arranged on the housing along a transverse direction which is perpendicular with respect to a running direction, which print heads are adjusted positionally with respect to at least one reference position, at least two hanger parts which are offset in the transverse direction being provided.

3. A. print-head module for a single-pass inkjet printer, the print-head module comprising:

a housing, a hanger part which is fastened to the housing and which is configured for hanging the print-head module oriented in the direction of gravity, and a number of print heads which are arranged on the housing along a transverse direction which is perpendicular with respect to a running direction, which print heads are adjusted positionally with respect to at least one reference position, catch means being arranged on the housing for rough positioning in relation to a provided printing position.

4. The print-head module as claimed in claim 3, the catch means being formed by a wedge shaft.

5. The print-head module as claimed in claim 4, the wedge shaft being configured to form a substantially vertical slide guide with a mating piece.

6. The print-head module as claimed in claim 3, a groove depression which is oriented parallel to the running direction being provided as catch means.

7. A print-head module for a single pass inkjet printer, the print-head module comprising:

a housing, a hanger part which is fastened to the housing and which is configured for hanging the print-head module oriented in the direction of gravity, and a number of print heads which are arranged on the housing along a transverse direction which is perpendicular with respect to running direction, which print heads are adjusted positionally with respect to at least one reference position, at least two bearing pieces which are offset in the transverse direction and are configured in each case for self-adjusting positioning in an open being arranged on the housing.

8. The print-head module as claimed in claim 7, the bearing pieces being height-adjustable.

9. The print-head module as claimed in claim 7, one of the bearing pieces being configured for positioning in a locating bearing and another of the bearing pieces being configured for positioning in a floating bearing in the transverse direction.

10. The print-head module as claimed in claim 7, the bearing pieces being configured in each case as ball pivots.

11. A print-head module for a single pass inkjet printer, the print-head module comprising:

a housing, a hanger part which is fastened to the housing and which is configured for hanging the print-head module oriented in the direction of gravity, and a number of print heads which are arranged on the housing along a transverse direction which is perpendicular with respect to a running direction, which print heads are adjusted positionally with respect to at least one reference position, which print-head module comprises a stop piece for bearing against a stop face.

12. The print-head module as claimed in claim 11, the stop piece comprising a ball pivot which extends in the transverse direction.

13. The print-head module as claimed in claim 7, the print heads being adjusted positionally in each case with respect to the bearing pieces.

14. The print-head module as claimed in claim 3, at least one of control electronics and an ink supply tank being accommodated in the housing.

15. A print-head module for a single pass inkjet printer, the print-head module comprising:

a housing, a hanger part which is fastened to the housing and which is configured for hanging the print-head module oriented in the direction of gravity, and a number of print heads which are arranged on the housing along a transverse direction which is perpendicular with respect to a running direction, which print heads are adjusted positionally with respect to at least one reference position, the housing comprising a number of air slots, and an air feed into the housing interior being provided.

16. A print-head module for a single-pass inkjet printer, the print-head module comprising:

a housing comprising a number of air slots and an air feed into the housing interior being provided;

a connection part which is fastened to the housing for gravity-oriented connection; and a number of print heads which are arranged on the housing along a transverse direction which is perpendicular with respect to a running direction, which print heads are adjusted positionally with respect to at least one reference position.

17. The print-head module as claimed in claim 2, at least one of control electronics and an ink supply tank being accommodated in the housing.

18. The print-head module as claimed in claim 2, catch means being arranged on the housing for rough positioning in relation to a provided printing position.

19. The print-head module as claimed in claim 2, at least two bearing pieces which are offset in the transverse direction and are configured in each case for self-adjusting positioning in an open bearing being arranged on the housing.

20. The print-head module as claimed in claim 2, which print-head module comprises a stop piece for bearing against a stop face.

* * * * *

UNITED STATES PATENT AND TRADEMARK OFFICE

CERTIFICATE OF CORRECTION

PATENT NO. : 8,960,858 B2
APPLICATION NO. : 13/701637
DATED : February 24, 2015
INVENTOR(S) : Patrik Lutz It is certified that error appears in the above-identified patent and that said Letters Patent is hereby corrected as shown below:

In the claims

In column 9, line 5, Claim 3, replace “A.” with --A--.

In column 9, line 38, Claim 7, replace “being” with --bearing being--.

Signed and Sealed this
Eighth Day of December, 2015

Michelle K. Lee

Michelle K. Lee
*Director of the United States Patent and Trademark Office*